United States Patent [19]

Beauchamp

[11] 4,145,478

[45] Mar. 20, 1979

[54] CALCIUM OXIDE OR HYDROXIDE TO IMPROVE THE CHARGE ACCEPTANCE OF ELECTROGRAPHIC DIELECTRIC RESINS

[75] Inventor: Gerson E. Beauchamp, Parkridge, Ill.

[73] Assignee: DeSoto, Inc., Des Plaines, Ill.

[21] Appl. No.: 819,849

[22] Filed: Jul. 28, 1977

[51] Int. Cl.[2] ..... G03G 5/022; H01B 3/10; H01B 3/42; H01B 3/44

[52] U.S. Cl. ..... 428/481; 96/1.5 R; 162/138; 252/63.2; 252/63.5; 427/121; 428/330; 428/511; 428/513; 428/537

[58] Field of Search ..... 427/121; 96/1.5; 428/511, 513, 330, 537, 481; 252/63, 632, 63.5; 260/33.4 R; 162/138

[56] References Cited

U.S. PATENT DOCUMENTS

| | | | |
|---|---|---|---|
| 3,847,661 | 11/1974 | Hill et al. | 428/513 |
| 3,924,050 | 12/1975 | Camp et al. | 427/121 |
| 3,944,705 | 3/1976 | Fujioka et al. | 427/121 |
| 3,946,140 | 3/1976 | Noe et al. | 428/511 |
| 3,950,594 | 4/1976 | Hohlfeld et al. | 428/511 |
| 3,991,253 | 11/1976 | Markhart et al. | 252/63.5 |
| 4,049,488 | 9/1977 | Honjo et al. | 96/1.5 R |
| 4,061,833 | 12/1977 | Pelletier et al. | 96/1.5 R |

*Primary Examiner*—John D. Smith
*Attorney, Agent, or Firm*—Dressler, Goldsmith, Clement, Gordon & Shore, Ltd.

[57] ABSTRACT

The charge accepting capacity of electrographic dielectric coatings is improved by dispersing in an organic solvent-soluble thermoplastic insulating resin having carboxyl functionality providing an acid value of from 5–100, from 0.05–3% by weight of calcium oxide or calcium hydroxide.

3 Claims, No Drawings

CALCIUM OXIDE OR HYDROXIDE TO IMPROVE THE CHARGE ACCEPTANCE OF ELECTROGRAPHIC DIELECTRIC RESINS

The present invention relates to improving the charge acceptance of electrographic dielectric resins.

Electrographic dielectric resins are useful in electrographic copying processes where they function to accept and hold an electrostatic charge which is deposited upon them in any desired fashion. The greater the charge, the larger the amount of toner particles which are attracted and held, and the greater the print density which is obtained. In accordance with this invention it has been found that calcium hydroxide and/or calcium oxide increases the charge accepting capacity of insulating carboxyl-functional resins, and especially acrylic copolymers.

Monovalent hydroxides, such as sodium or lithium hydroxides, tend to make the resin coatings more conductive, and thus lower the charge acceptance of the unmodified coating. Polyfunctional hydroxides and oxides other than calcium tend to cause the carboxyl-functional resin to precipitate which is undesirable, and the increase in charge acceptance is only moderate. Calcium oxide and calcium hydroxide, on the other hand, provide a larger increase in charge acceptance, and undesirable precipitation is minimized, especially when an alcohol is present in the resin solution which is modified.

The calcium oxide or hydroxide is used in an amount of from 0.05–3% of the weight of the carboxyl-functional resin, preferably from 0.1–2%.

The carboxyl-functional resin may be constituted by any organic solvent-soluble thermoplastic resin which contains only hydroxyl functionality as an optional addition to the carboxyl functionality which is needed. The carboxyl functionality can range from an acid value of 5–100, preferably from 10–80, and most preferably from 20–50.

While polyester resins are useful herein, such as a polyester formed by the polyesterification of 55 mol percent of phthalic anhydride with 45 mol percent of 1,4-butane diol, the preferred resins are solvent solution copolymers of monoethylenically unsaturated monomers containing at least 85% of monomers in which the $CH_2{=}C<$ group is the sole reactive group, preferably at least 90%. These are illustrated by $C_1$-$C_8$ alkyl esters of acrylic or methacrylic acid, such as methyl methacrylate or ethyl acrylate, styrene, vinyl toluene, vinyl acetate, acrylonitrile, vinyl chloride, and the like. These monomers preferably contain only carbon, hydrogen and oxygen.

The copolymers preferably include from 0.5–10%, preferably from 1.0–8%, of monoethylenic carboxylic acid illustrated by acrylic acid, methacrylic acid, crotonic acid, maleic acid and itaconic acid. Hydroxy functional monomers which may be present are illustrated by hydroxy ethyl methacrylate.

The resins are used in organic solvent solution which may be modified to include mineral fillers such as clay or lithopone (barium sulfate-zinc sulfide commercial mixture). Calcium carbonate, aluminum silicate, titanium dioxide and the like are also useful. The mineral filler provides the desired esthetic appearance and a rough surface, and is normally used in a pigment to binder ratio of from 1:1 to 4:1.

An alcohol, and particularly a monohydric alcohol or an ether alcohol, containing up to 6 carbon atoms, is desirably present to minimize the opalescence introduced by the calcium pigment. Ethyl alcohol, propyl alcohol, butyl alcohol, and 2-ethoxy ethanol will illustrate the useful alcohols. Ethyl alcohol is preferred. Amounts of at least 3% of the weight of the resin provide the desired clarity. Larger amounts of alcohol up to about 100% of the weight of the resin may be used, preferably 5%–30%.

The calcium oxide or hydroxide is used as a finely divided powder, preferably 325 mesh or finer, and it is dispersed uniformly in the resin solution using simple mixing, or high speed mising where desired. Calcium hydroxide is preferred.

The calcium-containing resin solution is itself an article of commerce, and it is usually mixed with the mineral fillers prior to use. As will be appreciated, the coatings herein are normally deposited upon a conductive paper and dried, preferably with a coating weight of from 5–7 pounds of dried coating per ream (3300 ft.$^2$) of paper.

Other resins in an amount up to 50% of the weight of the carboxyl functional resin may be used for special purpose. Thus, a low molecular weight homopolymer of alpha-methyl styrene provides curl resistance to the final coated paper.

The invention is illustrated in the following examples.

EXAMPLE 1

Copolymer Preparation

A three-liter flask, equipped with an agitator, a condenser, a heating mantel, a nitrogen blanket, a thermometer and a dropping funnel was charged with 330 grams of xylene and the xylene was heated to 125° C.

Then a mixture of 495 grams of styrene, 485 grams of ethyl acrylate, 20 grams of acrylic acid, 4.0 grams of benzoyl peroxide and 8.0 grams of tertiary butyl perbenzoate was gradually added over a 2½ hour period to the flask. This reaction mixture was held for an additional four hours at the temperature of 125° C., and then the product was diluted with toluene to 60% nonvolatile solids, cooled, and packaged.

EXAMPLE 2

Copolymer Solution

Place 3000 grams of the copolymer solution of Example 1 at 50.0% solids (diluted with toluene) in a container and add:

150.0 grams of a homopolymer of alpha-methyl styrene of low molecular weight. The product 276-V-2 of Dow Chemical Co. may be used.
150.0 grams of ethyl alcohol
376.7 grams of toluene
4.5 grams of calcium hydroxide, fine powder, technical grade sold by Sargent Welch as catalog item number S. C. 11222 (100% passes through a 325 mesh screen)

Stir the mixture at a sufficient speed and time for an even distribution. Simple mixing is sufficient, but a high speed mixer can be used.

EXAMPLE 3

Pigmentation & Application

The calcium-containing copolymer solution of Example 2 is pigmented to a pigment to binder ratio of 2.5:1 using an 11:4 weight ratio mixture of lithopone and treated clay (Translink 37-Freeport Kaolin Company, New York, N.Y.). The clay can be omitted or untreated clay can be used in its place. This pigmented solution is applied to conductive paper using a #12 wire wound rod to deposit 5–7 pounds dry coating weight per ream of paper and the coating is dried. The presence of the calcium increased the voltage which can be retained on the coated paper.

I claim:

1. An electrographic dielectric layer having improved charge accepting capacity consisting essentially of a layer of organic solvent-soluble thermoplastic insulating resin having carboxyl functionality providing an acid value of from 5–100, and calcium oxide or calcium hydroxide dispersed in said layer in an amount of from 0.05–3% of the weight of said resin.

2. A layer as recited in claim 1 containing mineral filler in a pigment to binder ratio of from 1:1 to 4:1.

3. Conductive paper coated with the layer defined in claim 1.

* * * * *